US010940965B2

(12) United States Patent
Sytema et al.

(10) Patent No.: US 10,940,965 B2
(45) Date of Patent: Mar. 9, 2021

(54) DEVICE AND METHOD FOR ASSEMBLING ITEMS FOR SHIPMENT

(71) Applicant: QUADIENT TECHNOLOGIES FRANCE, Bagneux (FR)

(72) Inventors: Herman Sytema, Drachten (NL); Fokke De Boer, Drachten (NL)

(73) Assignee: Quadient Technologies France, Bagneux (FR)

( * ) Notice: Subject to any disclaimer, the term of this patent is extended or adjusted under 35 U.S.C. 154(b) by 325 days.

(21) Appl. No.: 15/676,640

(22) Filed: Aug. 14, 2017

(65) Prior Publication Data

US 2018/0050828 A1 Feb. 22, 2018

(30) Foreign Application Priority Data

Aug. 16, 2016 (DE) ..... 102016115214
Oct. 28, 2016 (EP) ..... 16196330

(51) Int. Cl.
*B65B 5/06* (2006.01)
*B65B 43/10* (2006.01)
(Continued)

(52) U.S. Cl.
CPC ..... *B65B 5/06* (2013.01); *B65D 25/06* (2013.01); *B65B 5/024* (2013.01); *B65B 43/10* (2013.01); *B65B 2210/04* (2013.01)

(58) Field of Classification Search
CPC ..... B65B 5/06; B65B 5/024; B65B 43/10; B65B 2210/04; B65D 25/06; B65D 25/04; B65D 43/12; B65D 43/20; B65D 21/0233
(Continued)

(56) References Cited

U.S. PATENT DOCUMENTS 1,571,235 A * 2/1926 Deppa ..... B65B 67/02 53/255
3,500,609 A * 3/1970 Gunyou ..... B65B 63/02 53/528
(Continued)

FOREIGN PATENT DOCUMENTS

WO 2013/117852 A1 8/2013
WO 2014/117817 A1 8/2014
(Continued)

OTHER PUBLICATIONS

Extended European Search Report, dated Jun. 12, 2017, for European Application No. 16196330.1-1708, 6 pages.

*Primary Examiner* — Thomas M Wittenschlaeger
(74) *Attorney, Agent, or Firm* — Cozen O'Connor

(57) ABSTRACT

A device and a method for assembling items for shipment are described, that facilitate positioning the assembled items, e.g., in a pre-folded cardboard box having at least an open top and an open side or on a conveyor transporting the items. The device may include; a bottom panel, two side panels, a first and a second end panel, wherein the bottom panel is substantially orthogonal to the side panels and the end panels, wherein the first end panel is arranged on the device to be movable with respect to the bottom panel, the first end panel being movable in a direction substantially orthogonal to the bottom panel and wherein the second end panel is arranged on the device to be movable towards and away from the first end panel in a direction substantially parallel to the bottom panel.

19 Claims, 6 Drawing Sheets

(51) Int. Cl.
*B65B 5/02* (2006.01)
*B65D 25/06* (2006.01)

(58) Field of Classification Search
USPC ..... 220/345.1, 534, 543, 544; 206/514
See application file for complete search history.

(56) References Cited

U.S. PATENT DOCUMENTS

| | | | | |
|---|---|---|---|---|
| 5,131,210 | A * | 7/1992 | Kiya | B65B 27/125 100/247 |
| 5,224,911 | A * | 7/1993 | Wong | B65B 63/02 220/4.28 |
| 9,051,083 | B1 * | 6/2015 | Davis | B65D 25/06 |
| 10,287,048 | B2 * | 5/2019 | Sytema | B65B 43/126 |
| 2014/0026521 | A1 * | 1/2014 | Beal | B65D 25/06 53/428 |
| 2014/0251852 | A1 * | 9/2014 | Close | B65B 5/06 206/459.5 |
| 2015/0001168 | A1 * | 1/2015 | Busby | A47F 7/0035 211/59.2 |
| 2015/0013278 | A1 * | 1/2015 | Durand | B65D 5/0005 53/484 |
| 2015/0367974 | A1 * | 12/2015 | Sytema | B65B 43/14 53/461 |
| 2018/0016043 | A1 * | 1/2018 | Yokota | B65B 5/06 |
| 2018/0134421 | A1 * | 5/2018 | Ponti | B65B 57/10 |
| 2019/0055050 | A1 * | 2/2019 | Phillips | B65D 5/48 |

FOREIGN PATENT DOCUMENTS

| | | | |
|---|---|---|---|
| WO | 2016/059218 | A1 | 4/2016 |
| WO | 2016/157089 | A1 | 10/2016 |

* cited by examiner

DEVICE AND METHOD FOR ASSEMBLING ITEMS FOR SHIPMENT

TECHNICAL FIELD

This application relates to a device and a method for assembling items for shipment.

BACKGROUND

Mail ordering has become a widely used way of buying goods. More and more companies offer virtual department stores, in which the customers can electronically put goods in a shopping cart that later will be transferred by the respective company into a dispatch order, so that in a warehouse a shipment comprising the items ordered (and sometimes additional items such as samples, vouchers, invoices, etc.) can be assembled based on the respective dispatch order.

While assembling a shipment in a warehouse is nowadays often done more or less fully automated, packaging the items to be shipped is still a challenge, in particular when a shipment comprises several items of different sizes and in different quantities. Often, the items to be packaged are provided automatically to a person packaging the items manually. Depending on the size and number of the items, the person selects a suitable box size. Generally the box is a cardboard box that upon packaging is assembled from a corresponding cardboard blank.

To automate the packaging process even in cases where the items vary in size and number, a system has been proposed in WO 2014/117817 A1 that allows creating a fully custom sized box, i.e., a box, of which width, length and height are adapted to the respective content of the box. The box is created from a roll or a stack of cardboard by cutting out and creasing a custom sized blank from which then the box is folded automatically.

To facilitate obtaining optimized dimensions for a box for packaging a number of items, WO 2016/157089 A1 proposes to arrange and re-arrange the items in a crate with movable sidewalls and a movable bottom until an arrangement with minimized packaging volume is found, to detect the dimensions of a box necessary to hold the arrangement, to cut out a cardboard blank having the dimensions necessary to fold the box, to place the crate with the items on the blank, to open the bottom of the crate to transfer the items onto the blank and to fold the blank around the items to create the box.

WO 2016/059218 A1 discloses a system and a method for automatically packaging items varying in size and number applying two separate packings, namely an inner packing surrounding the items to be packaged in a first direction, and an outer packing surrounding the inner packing in a second direction, said second direction being substantially perpendicular to the first direction such that the inner and the outer packing form a combined package enclosing the package items from all sides.

WO 2013/117852 A1 discloses a system and a method for reducing the height of a cardboard box to the apex of the highest item in the box.

While some of the known systems and methods work well for a number of applications, it has turned out that the packaging process can be optimized under a number of aspects. Depending in particular on the number and the shape of the items to be packaged, creating a custom sized box around items to be packaged can be difficult. In particular, if an arrangement of items is placed on a blank through the bottom of a crate as suggested by WO 2016/157089 A1, the arrangement tends to fall apart and in particular cylindrical items may roll away.

If pre-folded boxes are used as disclosed in WO 2013/117852 A1, of which only the height can be changed, the finished package may not be optimal with respect to volume, while transportation costs often do not only depend on the weight, but also on the volume of a package.

It has hence recently been proposed by the applicant to use a pre-folded cardboard box to receive one or more item(s) to be packaged, said pre-folded cardboard box having a bottom panel, two side panels and a first end panel, the side panels and the end panel being erected from the bottom panel to form a box having an open top and an open side, the bottom panel having an end portion intended to form a second end panel, each side panel having an end portion intended to form a corner panel.

Once the items are placed in the open box, the end portions of the bottom and the side panels are folded to close the open side, and a lid may be placed on the box to close the open top, while the end portions may be shortened prior to folding, which advantageously allows customizing the box in at least one dimension (namely the so-called length (sometimes also called depth), which is defined by the length of the bottom panel between the first and the second end panel). In a preferred embodiment, the panels defining the height of the box (i.e. the length of the respective erected panels in the direction from the bottom panel to the open top of the box) may also be shortened to reduce the height of the box.

SUMMARY

A device and a method for assembling items for shipment are described, that facilitate positioning the assembled items, e.g., in a pre-folded cardboard box having at least an open top and an open side or on a conveyor transporting the items.

The device is set out in independent claim 1 the method in claims 9-12 and 15. The respective dependent claims refer to advantageous embodiments of the respective independent claims.

Further details and advantages of the various embodiments of the invention will become apparent from the following description of preferred embodiments in conjunction with the drawings.

DESCRIPTION OF PREFERRED EMBODIMENTS

Figure 1:
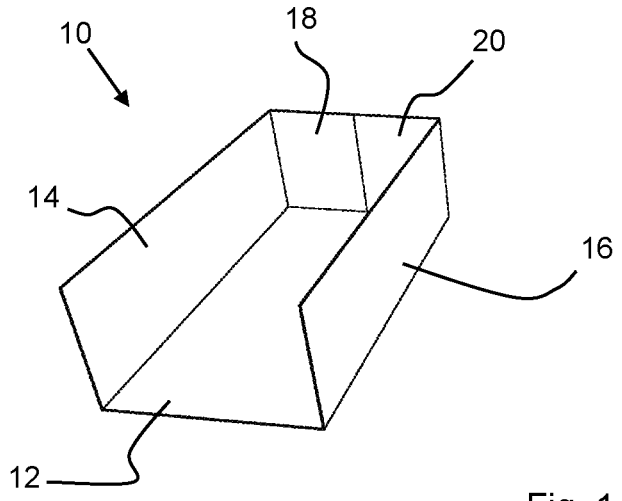
FIG. 1 shows a pre-folded cardboard box.

FIG. 1 shows a pre-folded box 10 having a bottom panel 12, two side panels 14 and 16 and two first corner panels 18 and 20 as well as a first end panel, which in this view is covered by the first corner panels 18 and 20. The panels are folded to form a box having an open top and an open side.

Figure 2:
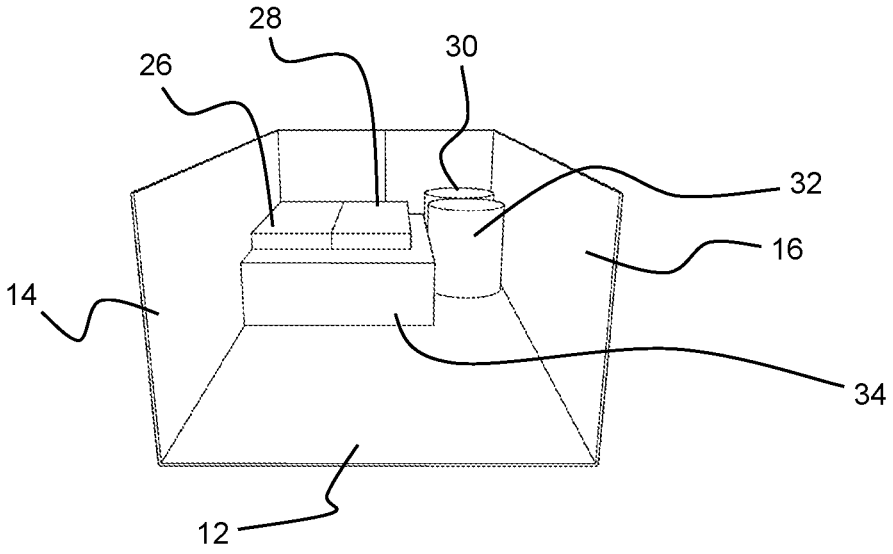
FIG. 2 shows the pre-folded box according to FIG. 1, in which some items to be packaged in the box are arranged.

FIG. 2 shows a different perspective of the pre-folded box according to FIG. 1 in a situation, in which some items 26, 28, 30, 32 and 34 have been placed in the box. In order to optimize the box with respect to volume, the pre-folded box is then adapted to the dimensions of the arrangement of items in the box by shortening the panels forming the box as will now be described.

Figure 3:
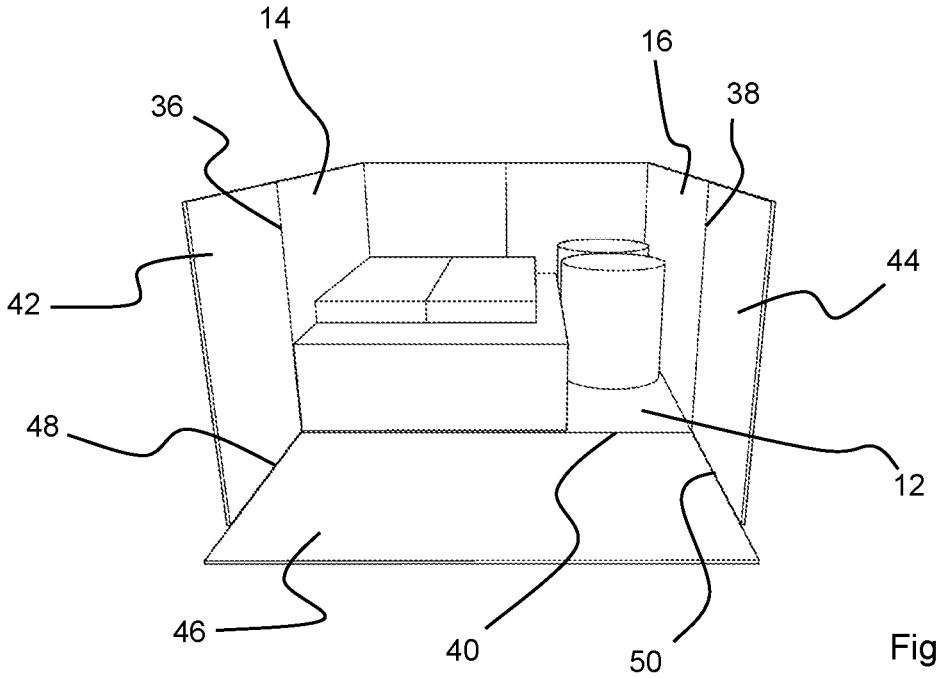
FIG. 3 shows the box according to FIG. 2 after the end portions of the side panels and the bottom panel have been shortened and after crease lines have been introduced in the side panels and the bottom panel to define second corner panels and a second end panel.

FIG. 3 shows the situation, in which the bottom panel 12 and the side panels 14 and 16 have been shortened by cutting, and crease lines 36, 38 and 40 have been introduced into the side panels 14 and 16 respectively the bottom panel 12, such that the end portions of the side panels 14 and 16 now define second corner panels 42 and 44, and the end portion of the bottom panel 12 defines a second end panel 46. Cuts 48 and 50 have been introduced along the borderlines between the second corner panels 42 and 44 and the second end panel 46 in order to allow folding. This cutting can be done by the same cutting unit which also shortened the side panels 14 and 16 and the bottom panel 12 or by a separate unit. The cutting as well as the shortening can obviously be done prior to, parallel to or after introducing the crease lines 36, 38 and 40.

The second corner panels 42 and 44 are then folded inwards around the crease lines 36 and 38. Prior to or after folding, glue can be applied to the second end panel 46 on the side facing the second corner panels 42 and 44 and/or to the second corner panels 42 and 44 on the side facing the second end panel 46. The second end panel 46 is then folded around the respective crease line 40 against the second corner panels 42 and 44 to close the open side of the box.

Figure 4:
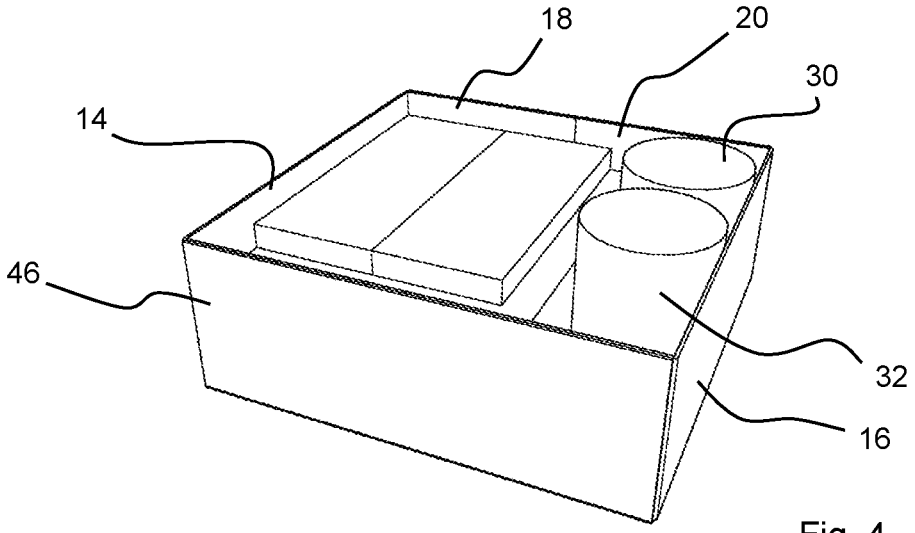
FIG. 4 shows the box according to FIG. 3 after the second corner panels have been folded inwards, after the second end panel has been folded upwards and after the height of the box has been shortened to the filling level of the box.

Finally, as shown in FIG. 4, the height of the box is shortened either to match or to be slightly greater than the maximum height of the arrangement of items in the box, which in this example is defined by the cylindrical items 30 and 32. For shortening the respective panels 14, 16, 18, 20 and 46 as well as the second corner panels and the first end panel, which in the view of FIG. 4 have no separate reference numbers, the same cutting unit, e.g. a laser cutting unit, that is used for shortening the end panel 12 and the side panels 14 and 16 as described in conjunction with FIG. 3 respectively for introducing the cuts 48 and 50 or a different cutting unit can be used. A lid (not shown) may then be placed on the open top of the box in order to close the box.

Figure 5:
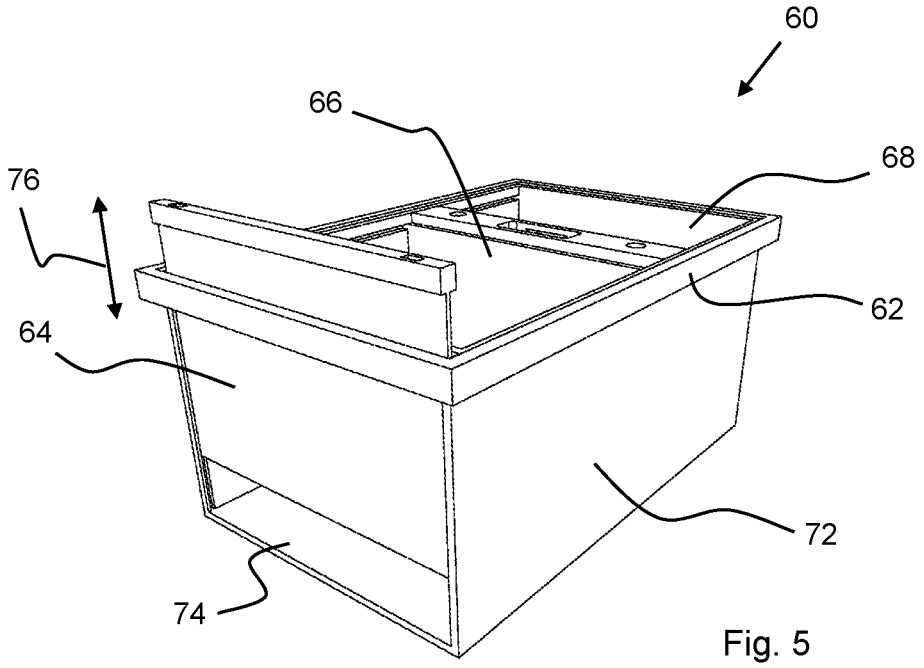
FIG. 5 shows a perspective view of a device according to a first embodiment of the invention, in which the first end panel is slid partially open.
Figure 6:
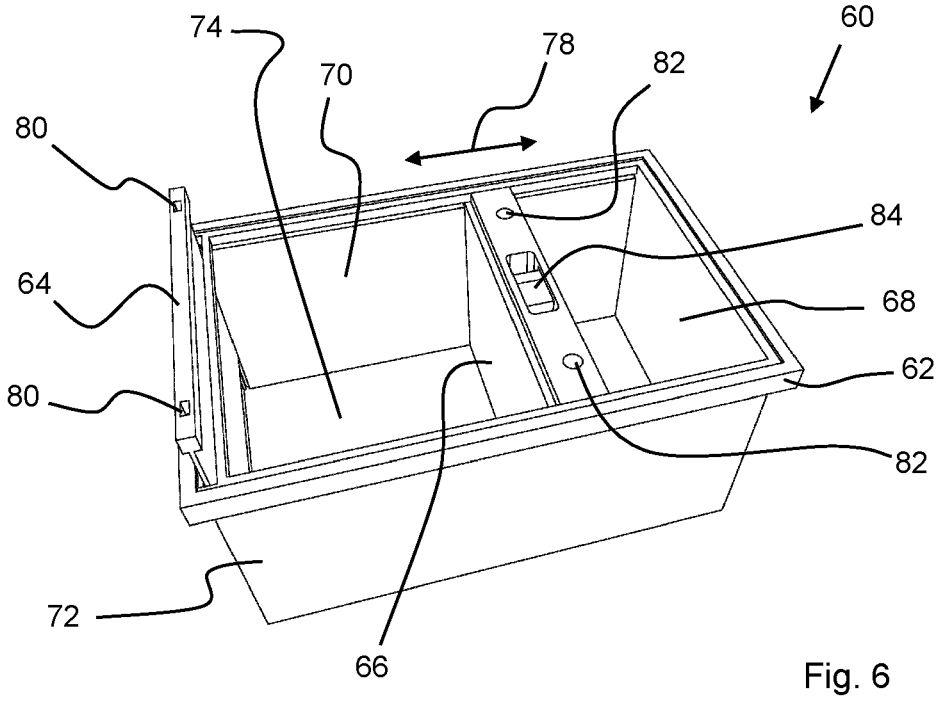
FIG. 6 shows the device according to FIG. 5 from a different perspective.

FIGS. 5 and 6 show a device 60 for assembling items for shipment according to a first embodiment of the invention. In this embodiment, the device comprises a stabilizing frame 62, to which a first end panel 64, a second end panel 66 and a third end panel 68 as well as two side panels 70 and 72 are attached. A bottom panel 74 is fixed to the side panels 70 and 72 and the third end panel 68. The end panels 64, 66 and 68 are substantially parallel to each other and orthogonal to both, the bottom panel 74 and the side panels 70 and 72. Accordingly, the side panels 70 and 72 are substantially parallel to each other, so that the device 60 forms a substantially rectangular box having an open top.

As indicated by arrows 76 and 78, the first end panel 64 and the second end panel 66 are movably arranged on the device 60. The first end panel 64 is movable in a direction 76 substantially orthogonal to the bottom panel 74 and parallel to the second end panel 66 in order to form an opening in the device, via which items placed in the device 60 can be transferred into a pre-folded box like the box shown in FIG. 1. In order to push items placed in the device 60 through the opening, second end panel 66 is movable parallel to the bottom panel 74 and towards the opening. In the situation shown in FIGS. 5 and 6, the opening is only partially opened to explain the function of the device 60. To ensure that all items are pushed out of the device 60, the second end panel 66 may be provided with a protrusion protruding towards the opening and having a thickness approximately corresponding to the distance between the opening at the front main surface of the second end panel when it is pushed into its closest position to the opening.

In this embodiment, both, the first end panel 64 and the second end panel 66 are provided with back tapered openings 80 and 82 allowing the respective end panels to be gripped by automatic gripping means for operating the respective end panel automatically. The second end panel 66 is also provided with a handle 84 for manually releasing a fixing mechanism in order to move the second end panel 66 towards the first end panel 64 or away from the first end panel as needed upon assembling items in the device 60.

The outer dimensions of the device 60 are adapted to the inner dimensions of the pre-folded box shown in FIG. 1 such that the device can be placed in the box. In use, one or more of the devices are taken by a human or robotic picker through a storage for example by placing the device(s) on a trolley, and the items, which shall be shipped together in a package, are placed in the device. In order to ensure that the items rest secure in the device, the device may be held such that the bottom panel 74 is inclined downwards from the first end panel to the second end panel or vice versa. The second end panel 66 may be adjusted as needed in order to adapt the size of the open space between the bottom panel 74, the first end panel 64, the second end panel 66 and the side panels 70 and 72 for receiving the items being assembled.

When all items to be shipped together in a package have been assembled in the device 60, the device is placed in a pre-folded box as shown in FIG. 1. The first end panel 64 is opened and the second end panel 66 is pushed towards the opening while the device itself and the box are moved relative to each other such that the device 60 is retracted from the box and the bottom panel 74 of the device and the bottom panel 12 (see FIG. 1) of the box move parallel relative to each other and the items are transferred from the device into the box.

Figure 7:
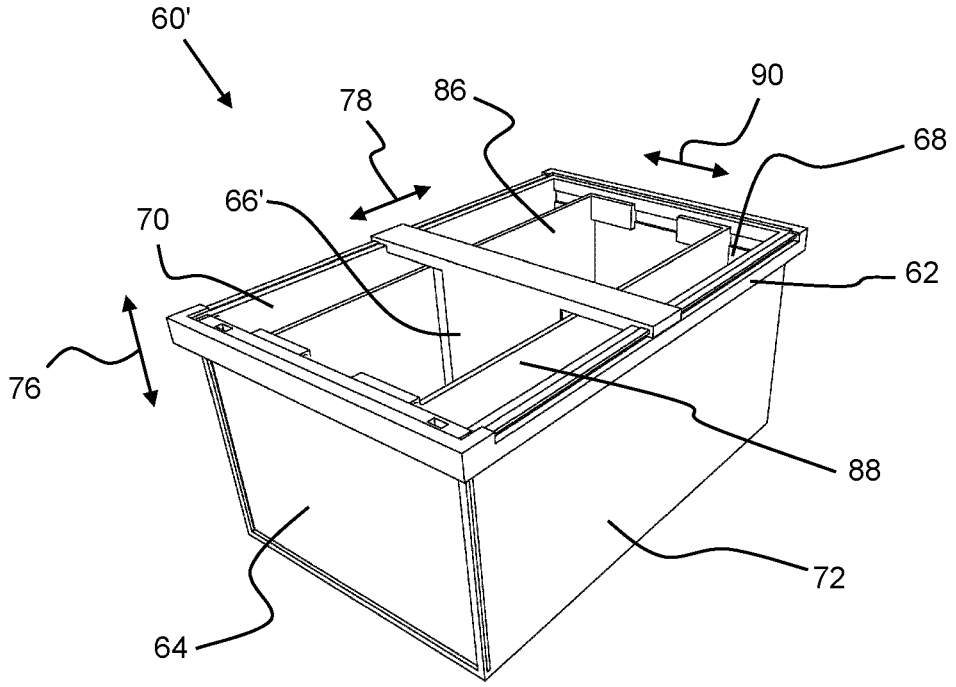
FIG. 7 shows a perspective view of a device according to a second embodiment of the invention having movable side panels.
Figure 8:
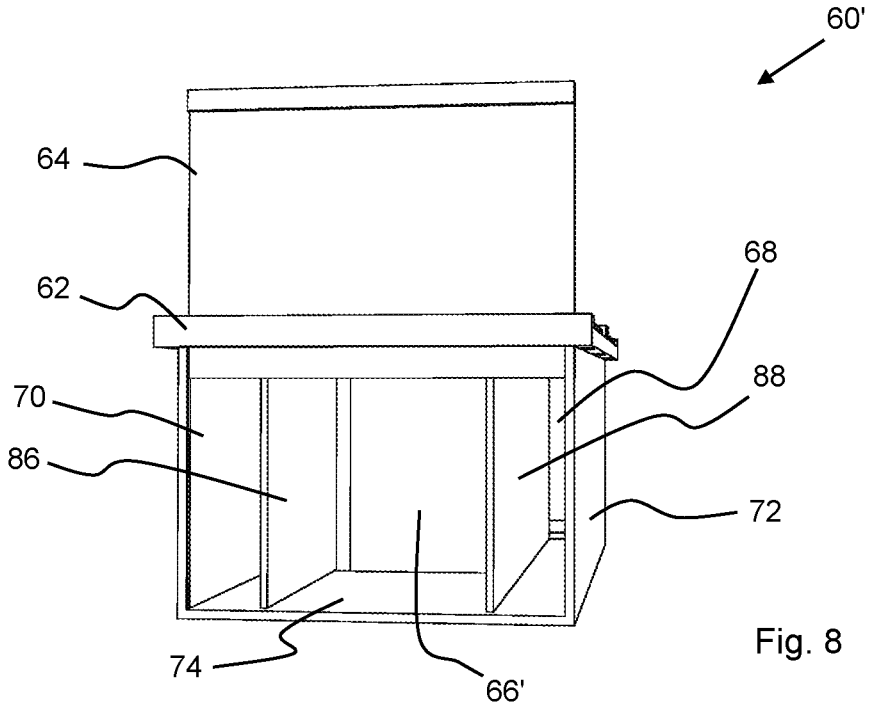
FIG. 8 shows the device according to FIG. 7 from a different perspective and after the first end panel has been slid into an opening position.

FIGS. 7 and 8 show a device 60' according to a second embodiment of the invention. The device also comprises a supporting frame 62, a first end panel 64, a second end panel 66' and a third end panel 68 as well as two side panels 70 and 72. The main difference to the device shown in FIGS. 5 and 6 is that besides fixed side panels 70 and 72, two movable inner side panels 86 and 88 are provided, which are movable towards and away from each other as indicated by arrow 90. In order to allow such movement, the second end panel 66' either has a reduced or an adjustable width, whereas the second end panel according to the first embodiment (66 in FIGS. 5 and 6) has a width that substantially corresponds to the inner width of the device.

Depending on the nature of the items to be shipped, a second end panel 66' having a reduced width may provide sufficient support for the items even in cases when the movable inner side panels 86 and 88 are not moved so far that they abut against the second end panel 66'. In other cases, a second end panel 66' having one or more extendable, e.g. telescoping panels may be used, such that the width of the end panel 66' is adjustable to the distance between the movable side panels 86 and 88. The telescoping panels may be spring biased into an extended position such that by moving the inner side panels 86 and 88 the width of the second end panel 66' is adjusted automatically. All movable panels may comprise a handle for manually releasing a respective fixing mechanism fixing them in their respective position and/or may be adapted to be moved by automated gripping means.

The device 60' is particularly useful when a huge variety of different shipments comprising different items have to be assembled. In order to be able to use packages having an optimal volume for the respective shipment, pre-folded boxes of different width can be provided at a corresponding packing station, where the items are transferred from the device into a pre-folded box. If pre-folded boxes are used having a width smaller than the outer width of the device, obviously the device cannot be placed in the respective pre-folded box as described in conjunction with FIGS. 5 and 6, but will be placed in front of the box such that the open side of the box abuts against the opening that can be opened in the device by sliding the first end panel 64 in an open position. Alternatively, the items can be placed on a packaging blank that is folded around the items once the device is removed.

Figure 9:
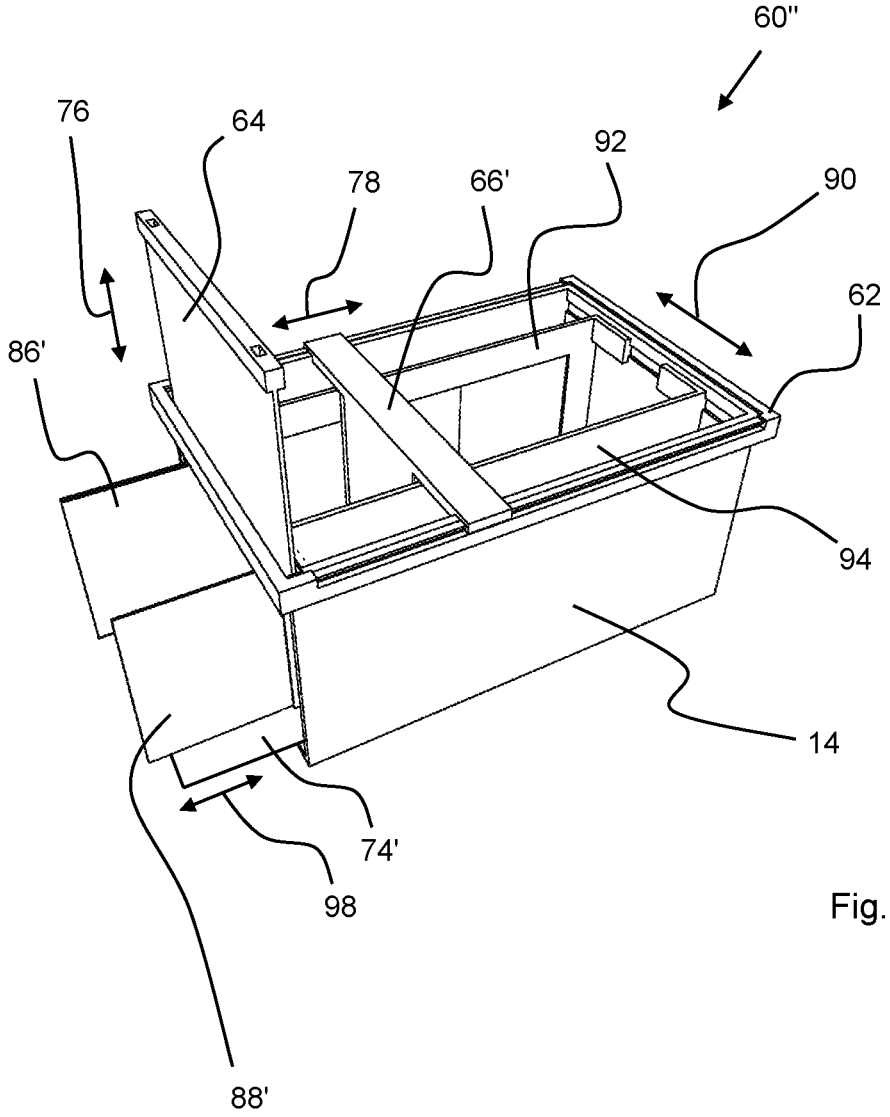
FIG. 9 shows a device according to a third embodiment of the invention in a state, in which the first end panel has been slid into an opening position and two side guide panels have been slid out of the opening opened by the end panel.

FIG. 9 shows a third embodiment of a device 60", which basically corresponds to the device shown in FIGS. 7 and 8, but in which the inner side panels 86' and 88' are held in respective frames 92, 94 so that after opening the first end panel 64, the inner side panels 86 and 88 can be slid through the opening in order to form guiding side panels for facilitating the transfer of items from the device into a corresponding pre-folded box or onto a packaging blank.

Within the scope of protection, which is solely defined by the appended claims, numerous variations and embodiments are possible. For example, instead of or additional to forming an opening in a device by sliding the first end panel 64 into an open position, it is as well possible to arrange bottom panel 74' to be movable in a direction 98 that is substantially orthogonal to the first end panel 64. Hence, if placed in a respective pre-folded box, the bottom panel 74' of the device 60" can be slid parallel to the bottom panel of the box in order to transfer items from the device into the box.

While the second embodiment described above comprises two movable side panels, the same effect, i.e. adjusting the width of the space provided in the device for assembling the items, can obviously be achieved by one fixed side panel and one movable side panel.

In order to provide guiding side panels as described in conjunction with the third embodiment, instead of holding the inner side panels in respective frames the inner side panels may themselves be provided with panels that can be slid through the opening when assembled items are transferred from the device into a box or onto a blank. If the device comprises such guiding panels, the device may be provided with a coupling mechanism for coupling the second end panel to the slidably arranged side panels prior to moving the second end panel parallel to the bottom panel so that by moving the second end panel also the respective side panels are moved.

In order to further automate the packaging process, the device may be provided with an identification unit, such as in particular an RFID tag, for automatically identifying the device.

In order to facilitate choosing a pre-folded box and/or adapting the dimensions of such box or of a blank for forming a box, the device may be provided with markers to easily and/or automatically determine the length and/or width of the space in the device provided for the items assembled and for determining the filling height of the device.

While the shown embodiments comprise a rigid bottom and a rigid first end panel, each of these panels may be formed by slats that are hinged together so that they can be wound up like a roller blind to open the front end and/or the bottom of the device.

If the device has an openable first end panel, the device may be used in a method for assembling items for shipment, comprising assembling items in the device, placing the device in a pre-folded box, said pre-folded box having an open top and one open side, or on a conveyor for conveying the items and transferring the items placed in the device by opening the first end panel, fixing the second end panel relative to the box respectively the conveyor and retracting the device from the box respectively from the conveyor. If the device has also an openable bottom panel, the bottom panel may be opened before retracting the device form the box respectively the conveyor. In this respect, it should be noted that obviously retracting the device from the box respectively the conveyor is a relative movement and either one or both of the box/the conveyor and the device can be moved to achieve the retraction. The device may be held at a small offset from the bottom panel of the box respectively the bottom of the conveyor so that no friction with the bottom panel of the box occurs upon retraction.

If the device has an openable first end panel, the device may also be used in a method for assembling items for shipment, comprising assembling items in the device, placing the device in front of a pre-folded box, said pre-folded box having an open top and one open side, or in front of a conveyor and transferring the items placed in the device by opening the first end panel and moving the second end panel towards the pre-folded box respectively towards the conveyor thus pushing the items out of the device into the box respectively onto the conveyor. Using a device as described herein for placing items on a conveyor allows handling of fragile items without human interaction and facilitates automatically supplying items belonging to a shipment coming from an order assembly system to an automatic packaging system.

If the device has an openable bottom panel, the device may be used in a method for assembling items for shipment, comprising assembling items in the device, placing the device in a pre-folded box, said pre-folded box having an open top and one open side, retracting the bottom panel of the device in order to form an opening in the bottom of the device and lifting the device out of the box.

If the device has an openable first end panel, the device may be used in a method for assembling items for shipment, comprising assembling items in the device, placing the device above a packaging blank for forming a cardboard box. In doing so, the device may either be put on the blank, so that it stands on the blank, or it might be held slightly above the blank, such that there would be no friction between the blank and the device when they are displaced with respect to each other. The items placed in the device are then transferred to a location of the packaging blank, where a bottom panel of the box will be formed from the blank, by opening the first end panel, fixing the second end panel relative to the packaging blank and displacing the device with respect to the packaging blank. If the device has side panels slidably arranged on the device, these side panels may be moved out of the device together with the items such that the panels guide the items laterally. Besides said bottom panel, the box to be folded from the blank typically comprises two side panels and two end panels, the side panels and the end panels being erected from the bottom panel. It is then advantageous to start the folding process while the panels guiding the items laterally are still in place, i.e., moved out of the device, by folding at least one, preferably two or three of the side and end panels upwards from the bottom panel. In this respect, it is obvious for an expert in the art that the so-called panels of the blank are defined by crease lines that are indented into the blank and that those crease lines may be indented prior to, parallel to or after transferring the items to the blank.

Figure 10:
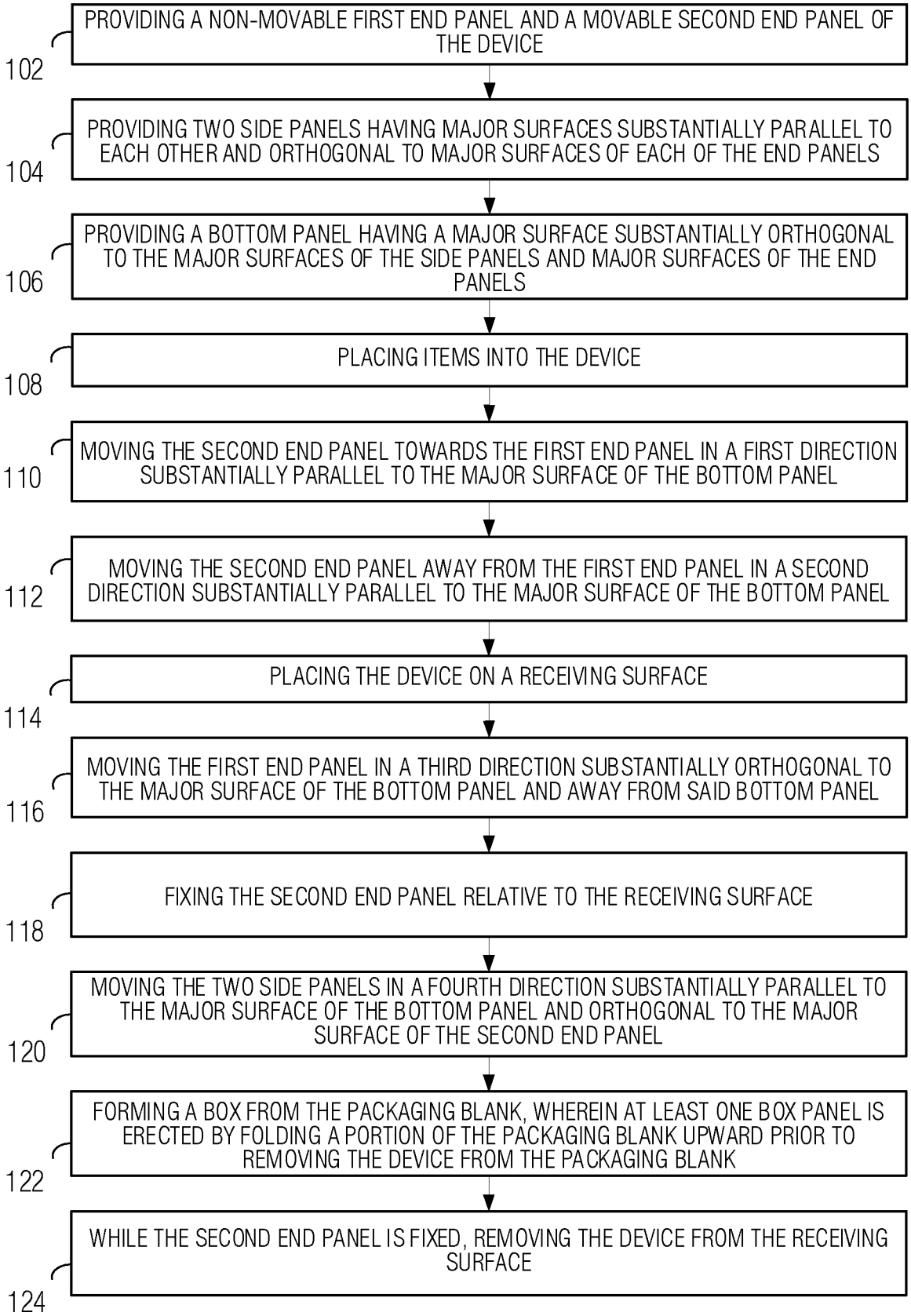
FIG. 10 is a flow diagram illustrating a method according to a related aspect of the embodiments.

FIG. 10 is a flow diagram illustrating a related method. The method includes providing a non-movable first end panel and a movable second end panel of the device at 102. At 104, two side panels having major surfaces substantially parallel to each other and orthogonal to major surfaces of each of the end panels are provided. At 106, the method includes providing a bottom panel having a major surface substantially orthogonal to the major surfaces of the side panels and major surfaces of the end panels. At 108, the items are placed into the device. At 110, the second end panel is moved towards the first end panel in a first direction substantially parallel to the major surface of the bottom panel. At 112, the method includes moving the second end panel away from the first end panel in a second direction substantially parallel to the major surface of the bottom panel. At 114, the device is placed on a receiving surface. At 116, the first end panel is moved in a third direction substantially orthogonal to the major surface of the bottom panel and away from said bottom panel. At 118, the second end panel is fixed relative to the receiving surface. At 120, the two side panels are moved in a fourth direction substantially parallel to the major surface of the bottom panel and orthogonal to the major surface of the second end panel. Operation 122 includes forming a box from the packaging blank, wherein at least one box panel is erected by folding a portion of the packaging blank upward prior to removing the device from the packaging blank. At 124, while the second end panel is fixed, the device is removed from the receiving surface.

The invention claimed is:

1. A device for assembling items for shipment, comprising a bottom panel, two side panels, a first and a second end panel, wherein the bottom panel is substantially orthogonal to the side panels and the end panels, wherein the side panels each have major surfaces that are substantially parallel to each other and orthogonal to the end panels, wherein the first end panel is arranged on the device to be movable between a raised position and a lowered position with respect to the bottom panel, the first end panel being movable in a direction substantially orthogonal to a major surface of the bottom panel, wherein the device has a maximum height dimension that is the height of the device and that substantially corresponds to a height of each of the side panels and end panels when the first end panel is in the lowered position, and wherein among the first and second end panels, only the second end panel is arranged on the device to be movable towards the first end panel in a first direction substantially parallel to the major surface of the bottom panel and away from the first end panel in a second direction substantially parallel to the major surface of the bottom panel.

2. The device according to claim 1, wherein at least one of the side panels is arranged to be movable towards the other side panel in a third direction substantially parallel to a major surface of the second end panel and away from the other side panel in a fourth direction substantially parallel to the major surface of the second end panel.

3. The device according to claim 1, further comprising a third end panel being fixed on the device.

4. The device according to claim 1, further comprising a stabilizing frame to which at least the end panels are attached.

5. The device according to claim 1, wherein either said side panels or separate side panels are movably arranged on the device to be movable in a direction substantially parallel to the major surface of the bottom panel and orthogonal to said major surface of the second end panel.

6. The device according to claim 5, further comprising a coupling mechanism for coupling the second end panel to the movably arranged side panels prior to moving the second end panel parallel to the bottom panel.

7. The device according to claim 1, further comprising an identification unit for automatically identifying the device.

8. The device according to claim 1, wherein the bottom panel is arranged on the device to be movable with respect to a major surface of the first end panel, the bottom panel being movable in a direction substantially orthogonal to the major surface of the first end panel.

9. A method for assembling items for shipment, comprising:

assembling items in a device for assembling items for shipment, said device comprising:

a bottom panel, two side panels, a first and a second end panel, wherein a major surface of the bottom panel is substantially orthogonal to major surfaces of each of the side panels and the end panels, wherein the major surfaces of the side panels are substantially parallel to each other and orthogonal to the major surfaces of the end panels, wherein the first end panel is arranged on the device to be movable between a raised position and a lowered position with respect to a major surface of the bottom panel, the first end panel being movable in a direction substantially orthogonal to the major surface of the bottom panel, wherein the device has a maximum height dimension that is the height of the device and that substantially corresponds to a height of each of the side panels and end panels when the first end panel is in the lowered position, and wherein among the first and second end panels, only the second end panel is arranged on the device to be movable towards the first end panel in a first direction substantially parallel to the major surface of the bottom panel and away from the first end panel in a second direction substantially parallel to the major surface of the bottom panel.

10. The method according to claim 9, further comprising after assembling items in said device:

placing the device in a pre-folded box, said pre-folded box having an open top and one open side, and then transferring the items placed in the device by moving the first end panel of the device in said direction substantially orthogonal to the major surface of the bottom panel away from the bottom panel, fixing the second end panel of the device relative to the box and retracting the device from the box.

11. The method according to claim 9, wherein said device has the bottom panel arranged on the device to be movable with respect to the first end panel, the bottom panel being movable in a direction substantially orthogonal to a major surface of the first end panel, the method further comprising after assembling items in said device:

placing the device in a pre-folded box, said pre-folded box having an open top and one open side, and then moving the bottom panel of the device in said direction substantially orthogonal to the major surface of the first end panel away from the first end panel to form an opening in the bottom of the device and lifting the device out of the box.

12. The method according to claim 9, further comprising after assembling items in said device:

placing the device in front of a pre-folded box, said pre-folded box having an open top and one open side and then transferring the items placed in the device by moving the first end panel of the device in said direction substantially orthogonal to the major surface of the bottom panel away from the bottom panel, and moving the second end panel towards the pre-folded box thus pushing the items out of the device into the box.

13. The method according to claim 12, wherein said device has either said side panels or separate side panels movably arranged on the device to be movable in a direction substantially parallel to the major surface of the bottom panel and orthogonal to a major surface of the second end panel, and wherein upon pushing the items out of the device the side panels movably arranged on the device are moved out of the device together with the items.

14. The method according to claim 13, wherein the box after being folded from a packaging blank comprises at least a bottom panel, two side panels and two end panels, the side panels and the end panels being erected from the bottom panel, wherein at least one of the side and end panels is folded upward from the bottom panel prior to displacing the device.

15. A method for assembling items for shipment, comprising:

providing a device for assembling items for shipment, said device, including:

providing a non-movable first end panel of the device and a movable second end panel of the device;

providing two side panels of the device, the side panels having major surfaces that are substantially parallel to each other and orthogonal to major surfaces of each of the end panels;

providing a bottom panel of the device, the bottom panel having a major surface substantially orthogonal to the major surfaces of the side panels and major surfaces of the end panels;

placing said items into the device;

moving the second end panel towards the first end panel in a first direction substantially parallel to the major surface of the bottom panel;

moving the second end panel away from the first end panel in a second direction substantially parallel to the major surface of the bottom panel;

placing the device on a receiving surface;

transferring the items placed in the device to a location of the receiving surface, including:

moving the first end panel in a third direction substantially orthogonal to the major surface of the bottom panel and away from said bottom panel;

fixing the second end panel relative to the receiving surface; and while the second end panel is fixed, removing the device from the receiving surface.

16. The method according to claim 15, wherein the receiving surface is a bottom surface of a cardboard box.

17. The method according to claim 15, wherein the receiving surface is a packaging blank to be formed into a cardboard box after placement of the items.

18. The method according to claim 17, further comprising:

forming a box from the packaging blank, wherein at least one box panel is erected by folding a portion of the packaging blank upward prior to removing the device from the packaging blank.

19. The method according to claim 15, further comprising:

moving the items out of the device while moving the two side panels in a fourth direction substantially parallel to the major surface of the bottom panel and orthogonal to the major surface of the second end panel such that the two side panels move with the items.

* * * * *